US005877448A

United States Patent [19]

Denton et al.

[11] Patent Number: 5,877,448

[45] Date of Patent: Mar. 2, 1999

[54] REUSABLE GAS-POWERED WAR GAME LAND MINE

[75] Inventors: Robert Denton, Panama City; Robert Woodall, Lynn Haven; Felipe Garcia, Panama City, all of Fla.

[73] Assignee: The United States of America as represented by the Secretary of the Navy, Washington, D.C.

[21] Appl. No.: 986,981

[22] Filed: Dec. 8, 1997

[51] Int. Cl.[6] ..... F42B 23/10

[52] U.S. Cl. ..... 102/401; 102/498; 89/1.11; 434/11

[58] Field of Search ..... 434/11; 102/401, 102/498; 89/1.11

[56] References Cited

U.S. PATENT DOCUMENTS 4,210,082 7/1980 Brothers ..... 102/8
4,690,061 9/1987 Armer, Jr. et al. ..... 102/401
4,944,521 7/1990 Greeno ..... 273/428
5,018,449 5/1991 Edison, II ..... 102/498

*Primary Examiner*—Charles T. Jordan
*Assistant Examiner*—Chris J Brown
*Attorney, Agent, or Firm*—Harvey A. Gilbert; Kenneth W. Dobyns

[57] ABSTRACT

A reusable gas-powered war game land mine has at least one launch tube with one or more projectile(s) loaded therein. A compressed gas reservoir and rupturing device are provided with the rupturing device being movable in relationship to the seal of the compressed gas reservoir. A triggering mechanism is coupled to the rupturing device to move the rupturing device so that it impacts the seal when the triggering mechanism is activated. The rupturing device can define a channel through which the compressed gas is directed to the breech end of the launch tube(s) when the seal is broken. As a result, the compressed gas enters the breech end of the launch tube(s) to propel the projectile(s) therefrom.

18 Claims, 3 Drawing Sheets

REUSABLE GAS-POWERED WAR GAME LAND MINE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to land mines, and more particularly to a reusable, gas-powered war game land mine for ejecting projectiles such as paint balls.

BACKGROUND OF THE INVENTION

Land mines are in use around the world. They range from relatively small anti-personnel mines to large anti-tank mines. The explosion characteristics (e.g., direction of explosion and shrapnel) of land mines can vary greatly. Thus, to adequately prepare military personnel, good military training must account for and simulate not only the presence of land mines, but also their explosion characteristics. To do this, it is necessary to have practice land mines.

One practice land mine disclosed in U.S. Pat. No. 4,690,0621 sprays a marking agent slurry in a desired pattern when triggered. Handling of the slurry, however, is messy. Further, the slurry can clog the nozzles from which it is sprayed.

SUMMARY OF THE INVENTION

Accordingly, it is an object of the present invention to provide a non-lethal land mine that can simulate the explosion characteristics of a variety of lethal land mines.

Another object of the present invention is to provide a land mine that can be used in military and non-military war games.

Still another object of the present invention is to provide a land mine that is reusable.

Yet another object of the present invention is to provide a reusable land mine that is virtually maintenance free.

Other objects and advantages of the present invention will become more obvious hereinafter in the specification and drawings.

In accordance with the present invention, a land mine has at least one launch tube with a breech end and a muzzle end. At least one projectile is loaded in the launch tube(s) between the breech and muzzle ends. A rupturing device is movable in relationship to the seal of a compressed gas reservoir. The rupturing device can break the seal upon impact therewith. The rupturing device can define a channel through which the compressed gas can flow to the breech end when the seal is broken. A triggering mechanism is coupled to the rupturing device to move the rupturing device so that it impacts the seal when the triggering mechanism is activated. As a result, the compressed gas enters the breech end of the launch tube(s) to propel the projectile(s) therefrom at the muzzle end.

DETAILED DESCRIPTION OF THE INVENTION

Figure 1A:
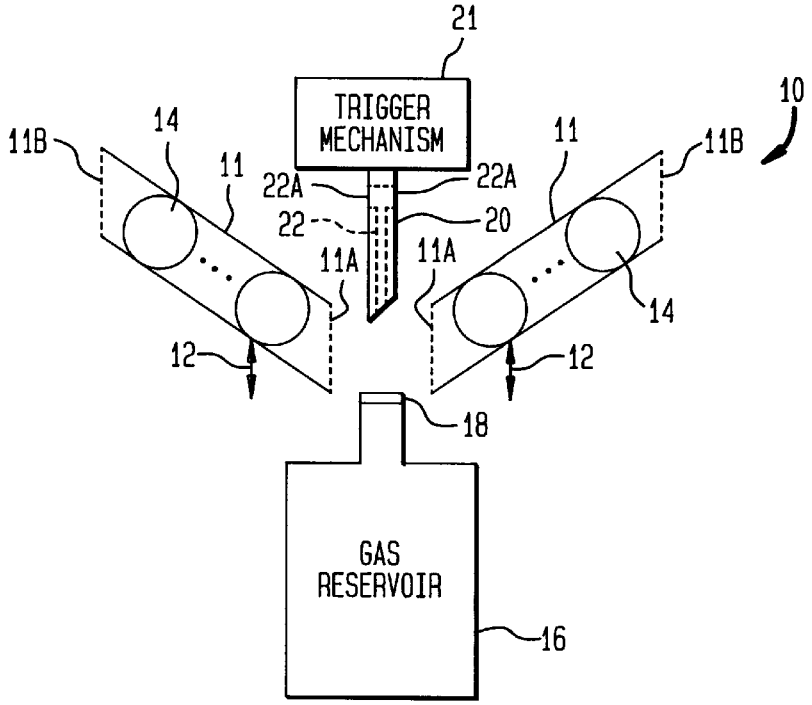
FIG. 1A is a schematic view of the land mine of the present invention prior to its activation.
Figure 1B:
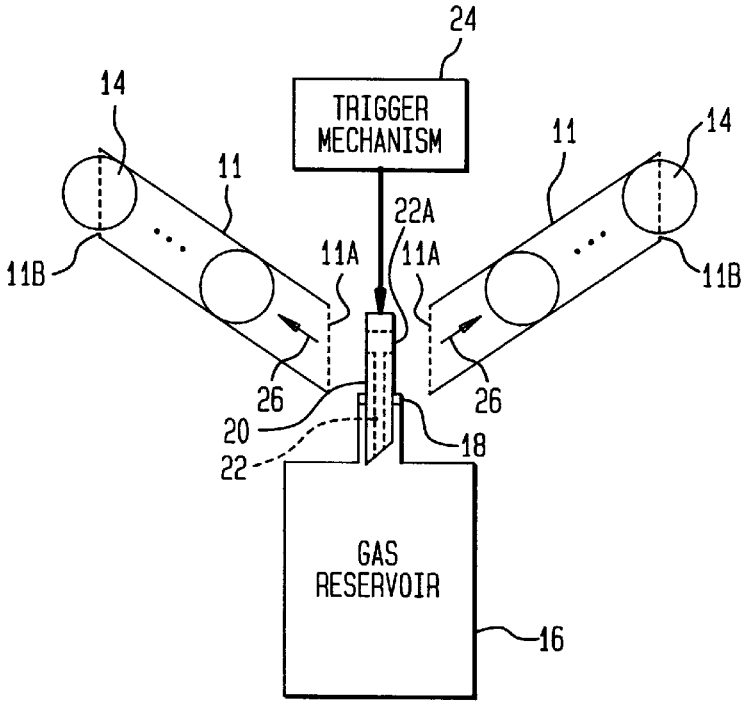
FIG. 1B is a schematic view of the land mine just after its activation.

Referring now to the drawings, and more particularly to FIGS. 1A and 1B, the reusable, gas-launched land mine 10 of the present invention is shown both prior to its activation in FIG. 1A and just after its activation in FIG. 1B. Land mine 10 can be used in both military and non-military scenarios to launch projectiles in a prescribed fashion. By way of example, it will be assumed herein that the scenario is a war game scenario in which case the projectiles are non-lethal in nature.

Land mine 10 includes one or more launch barrels or tubes 11, each of which is aimed in a particular direction. Each of launch tubes 11 can also be adjustable with respect to its aimpoint with the adjustability feature being indicated by two-headed arrows 12. Each launch tube 11 is loaded with one or more projectiles 14. In terms of a war game scenario, projectiles 14 can be frangible projectiles housing a marking agent (not shown). Such frangible projectiles are known in the art as paint balls. The marking agent can be a visible colorant or, in the case of security scenarios (e.g., banks, border crossings, etc.), the marking agent could be an ultraviolet-sensitive ink or any covert marking agent that could be detected at a later time and/or with special detectors.

To propel projectiles 14 from launch tubes 11, a non-lethal compressed gas (e.g., carbon dioxide, nitrogen, etc.) is provided within a gas tank or reservoir 16. Gas reservoir 16 is sealed at 18 by a rupturable seal. The release of the compressed gas into the breech end 11A of launch tubes 11 is controlled by a rupturing pin 20. Once seal 18 is ruptured by pin 20, the outflow of gas from reservoir 16 will tend to push pin 20 out of reservoir 16 into breech ends 11A. However, in the event pin 20 should get stuck in seal 18, pin 20 can have an internal channel 22 defined therein to ensure and direct the outflow of gas from reservoir 16 once seal 18 is ruptured.

Rupturing pin 20 is coupled to a triggering mechanism 24. Once armed, triggering mechanism 24 maintains separation between pin 20 and seal 18 (FIG. 1A), and moves pin 20 to impact and rupture seal 18 when triggering mechanism 24 is activated (FIG. 1B). More specifically, when land mine 10 is activated, triggering mechanism 24 causes pin 20 to rupture seal 18. The provision of internal channel 22 guarantees that the compressed gas in gas reservoir 18 will be directed therethrough and exit pin 20 at vents 22A which can be aligned with or coupled to each breech end 11A. The build-up of compressed gas in breech ends 11A indicated by arrows 26 causes projectiles 14 to launch from muzzle ends 11B.

Figure 2:
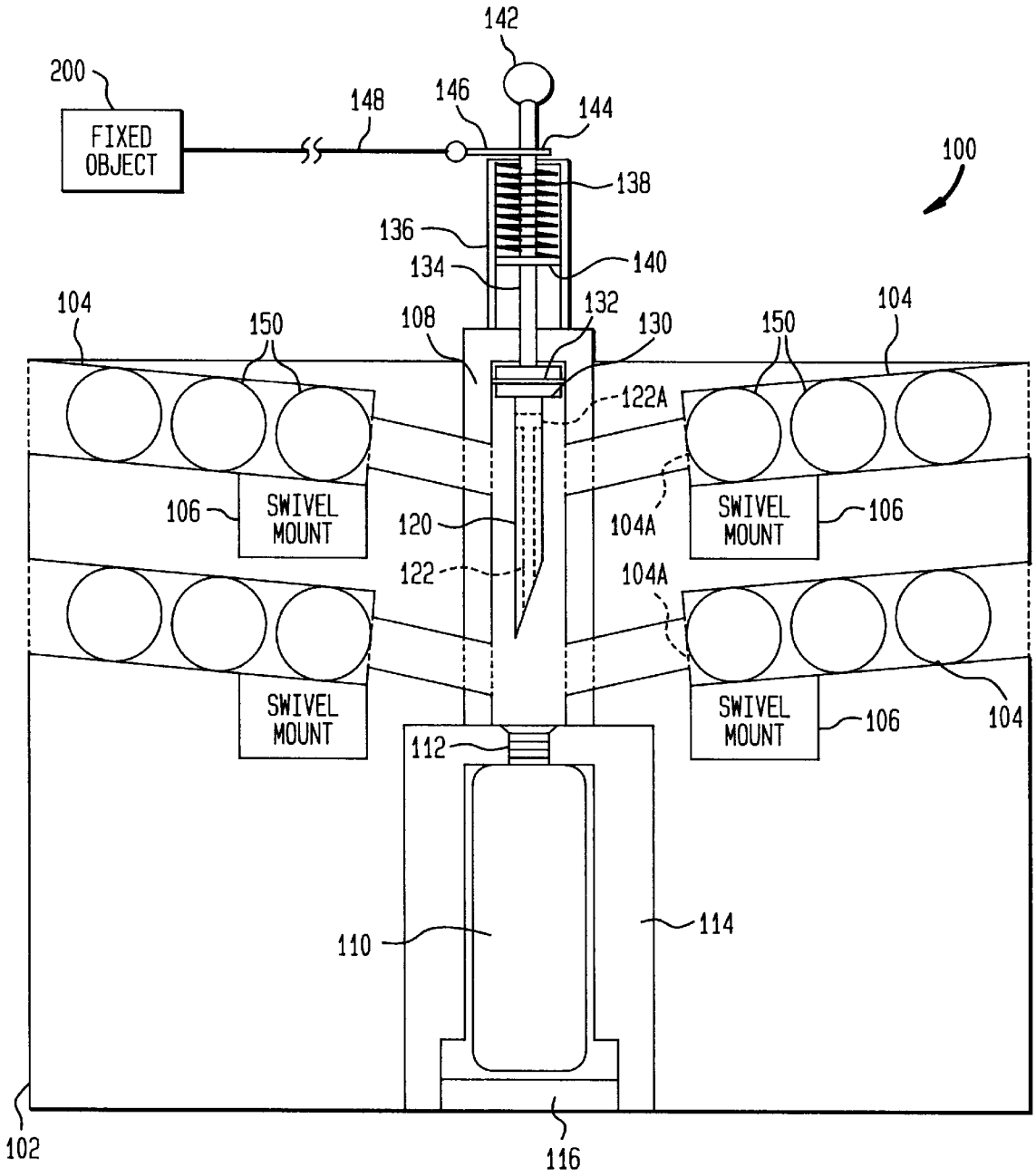
FIG. 2 is a detailed schematic of one embodiment of the gas-launched land mine according to the present invention shown in its armed position.
Figure 3:
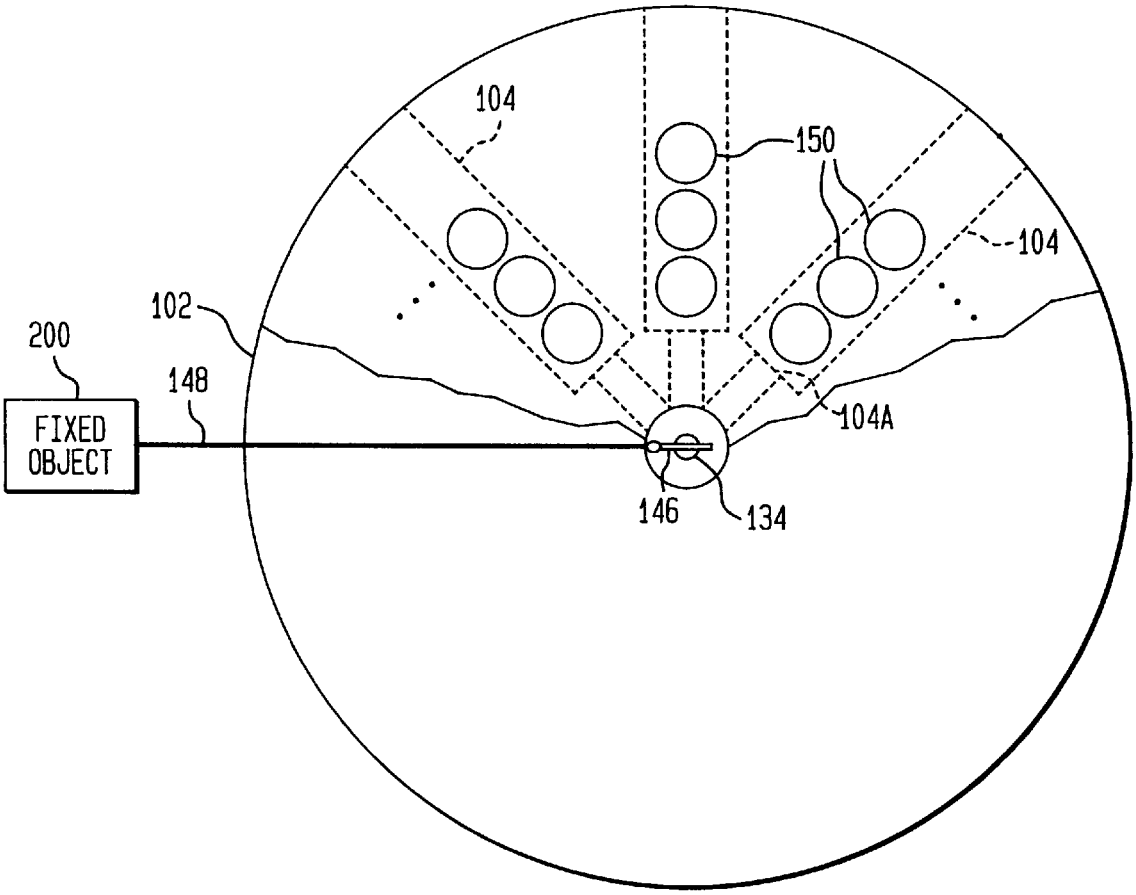
FIG. 3 is a top view partially cut away of the embodiment illustrated in FIG. 2.

While the present invention can be realized by a variety of embodiments, one such embodiment is shown by way of illustrative example in FIGS. 2 and 3. Land mine 100 includes a housing 102 having a plurality of launch tubes 104 arranged radially therearound. Launch tubes 104 can be arranged on a single tier or in multiple tiers as shown in FIG. 2. Each launch tube 104 can be permanently mounted (i.e., have a fixed aimpoint) or be mounted via a swivel mount 106 to allow for aimpoint adjustability. Still further, a portion of launch tubes 104 could be permanently mounted and the remainder could be adjustably mounted.

The breech end 104A of each launch tube is open to a manifold 108 that is centrally positioned with respect to breech ends 104A. Disposed beneath manifold 108 is a compressed gas tank 110 containing, for example, carbon dioxide under pressure. Gas tank 110 is housed within an internal receptacle 114 formed in housing 102. Gas tank 110 is inserted/removed from receptacle 114 via a removable cap 116. Receptacle 114 can be configured such that cap 116 will properly seat only if gas tank 110 is properly installed. A rupturing pin 120 having an internal channel 122 defined therein is provided in manifold 108. Channel 122 terminates in one or more vents 122A which empty into manifold 108. Accordingly, pin 120 and channel 122 are analogous to pin 20 and channel 22 described above.

An example of a simple and reusable mechanical triggering mechanism to move pin 120 into engagement with seal 112 is shown. Briefly, the triggering mechanism consists of a spring-locked ram assembly coupled to pin 120, a locking mechanism for maintaining the ram assembly in its spring-loaded position and a trip wire coupled to the locking mechanism. More specifically, the spring-loaded ram assembly consists of a ram piston 130 having an O-ring seal 132. Ram piston 130 with seal 132 are configured for a sealed, but sliding motion within manifold 108. Pin 120 is coupled to one side of ram piston 130 and a piston rod 134 is coupled to the other side of ram piston 130. Piston rod 134 extends up through a spring housing 136 in which a triggering spring 138 is housed. A spring seat 140 is attached to piston rod 134 within spring housing 136 beneath triggering spring 138. Thus, triggering spring 138 is captured between spring seat 140 and the top of spring housing 136. Where piston rod 134 protrudes from the top of spring housing 136, a handle 142 is attached thereto.

To arm land mine 100 as shown in FIG. 2, handle 142 is pulled up thereby causing spring seat 140 to move up in spring housing 136 to compress triggering spring 138. Handle 142 must be pulled up sufficiently to expose a pin hole 144 in piston rod 134 above spring housing 136. Once pin hole 144 is exposed, a trigger release pin 146 is inserted therethrough to lock triggering spring 138 in its compressed state. Since triggering spring 138 will tend to bias piston rod 134 downward, trigger release pin 146 is held in place against the top of spring housing 136. A trip line 148 is attached on one end to trigger release pin 146 and on its other end to some fixed object 200 such as a tree, stake, etc.

In operation, housing 102 is positioned on the ground or other surface and one or more projectiles 150 (e.g., paint balls) are loaded into launch tubes 104. The aimpoints of launch tubes 104 are selected based on topography and the area into which it is desired to launch the projectiles. The mine may be loaded such that only a sector or a full 360° is covered by launched projectiles. The mine may also be elevated to strike objects in line at 3–6 feet off the ground to simulate a "Bouncing Betty" type of anti-personnel mine.

Handle 142 is pulled up and trigger release pin 146 is inserted as described above to arm land mine 100. When trip line 148 is tensioned sufficiently, trigger release pin 146 is pulled out from piston rod 134. Triggering spring 138 then expands to move ram piston 130 and rupturing pin 120 down in manifold 108. Once pin 120 pierces seal 112, the compressed gas in gas tank 110 enters manifold 108 via channel 122 and vents 122A. As the gas expands, it spreads to each breech end 104A having one or more projectiles 150 loaded therein as a means of propelling the projectiles therefrom.

The advantages of the present invention are numerous. The land mine can eject standard paint balls or other non-lethal projectiles using readily-available gas cartridges. The land mine is simple to construct and can be easily used over and over again. The present invention will find great utility in military training, for recreational war games and in security scenarios where it is desirable to mark intruders for later detection.

Although the invention has been described relative to a specific embodiment thereof, there are numerous variations and modifications that will be readily apparent to those skilled in the art in light of the above teachings. For example, an additional pin (not shown) similar to trigger release pin 146 can be provided through piston rod 134. This additional pin would serve as a safety in case pin 146 were removed prematurely or inadvertently. Naturally, this additional safety pin would be removed before the land mine would be considered fully armed. Other alternatives could include the use of a different triggering mechanism than the one detailed herein. For example, the triggering mechanism "sensor" could be implemented using acoustic, optic or other electronic sensors in place of the trip wire. Still further, projectiles other than paint balls can be used in the present invention. It is therefore to be understood that, within the scope of the appended claims, the invention may be practiced other than as specifically described.

What is claimed as new and desired to be secured by Letters Patent of the United States is:

1. A land mine, comprising:

at least one launch tube having a breech end and a muzzle end;

at least one projectile loaded in said at least one launch tube between said breech end and said muzzle end;

a reservoir for storing a compressed gas and having a seal;

a rupturing device movable in relationship to said seal for breaking said seal upon impact therewith, said rupturing device defining a channel through which said compressed gas can flow from said reservoir to said breech end when said seal is broken; and a triggering mechanism coupled to said rupturing device for maintaining separation between said rupturing device and said seal, and for moving said rupturing device to impact said seal when said triggering mechanism is activated wherein said compressed gas enters said breech end of said at least one launch tube to propel said at least one projectile therefrom at said muzzle end.

2. A land mine as in claim 1 wherein said at least one launch tube comprises a plurality of launch tubes, said land mine further comprising a manifold coupling said channel to each said breech end of said plurality of launch tubes.

3. A land mine as in claim 1 wherein said at least one launch tube has an adjustable aimpoint.

4. A land mine as in claim 1 wherein said at least one projectile is a frangible projectile housing a marking agent.

5. A land mine as in claim 1 wherein said compressed gas is non-lethal.

6. A land mine as in claim 1 wherein said triggering mechanism comprises:

a spring-loaded ram coupled to said rupturing device, said spring-loaded ram having a spring-loaded position at which said separation is maintained between said rupturing device and said seal;

a locking mechanism coupled to said spring-loaded ram for maintaining said spring-loaded position; and a trip wire coupled to said locking mechanism for disabling said locking mechanism when tension is applied to said trip wire, wherein said spring-loaded ram is free to move said rupturing device to impact said seal.

7. A land mine, comprising:

a plurality of launch tubes, each of which has a breech end and a muzzle end, each of said plurality of launch tubes having a unique aimpoint;

at least one projectile loaded in each of said plurality of launch tubes between each said breech end and each said muzzle end;

a reservoir for storing a compressed gas and having a seal;

a manifold coupling said seal to each said breech end of said plurality of launch tubes;

a rupturing device movable through said manifold to break said seal upon impact therewith, said rupturing device defining a channel through which said compressed gas can flow from said reservoir into said manifold when said seal is broken; and a triggering mechanism coupled to said rupturing device for maintaining separation between said rupturing device and said seal, and for moving said rupturing device to impact said seal when said triggering mechanism is activated wherein said compressed gas enters each said breech end of said plurality of launch tubes via said manifold to propel said at least one projectile therefrom at each said muzzle end.

8. A land mine as in claim 7 wherein each said aimpoint is adjustable.

9. A land mine as in claim 7 wherein said at least one projectile is a frangible projectile housing a marking agent.

10. A land mine as in claim 7 wherein said at least one projectile comprises a plurality of projectiles in each of said plurality of launch tubes.

11. A land mine as in claim 7 wherein said compressed gas is non-lethal.

12. A land mine as in claim 7 wherein said triggering mechanism comprises:

a spring-loaded ram coupled to said rupturing device, said spring-loaded ram having a spring-loaded position at which said separation is maintained between said rupturing device and said seal;

a locking mechanism coupled to said spring-loaded ram for maintaining said spring-loaded position; and a trip wire coupled to said locking mechanism for disabling said locking mechanism when tension is applied to said trip wire, wherein said spring-loaded ram is free to move said rupturing device to impact said seal.

13. A land mine, comprising:

a housing for placement on a surface and defining a central chamber therein;

a plurality of launch tubes, each of said tubes has a breech end and an opposite muzzle end, each of said tubes disposed in said housing and arranged radially therearound such that each said breech end is coupled to said central chamber, each of said plurality of launch tubes having a unique aimpoint;

at least one projectile loaded in each of said plurality of launch tubes between each said breech end and each said muzzle end;

a reservoir for storing a compressed gas and having a seal positioned in said central chamber;

a rupturing device movable through said central chamber to break said seal upon impact therewith, said rupturing device defining a channel through which said compressed gas can flow from said reservoir into said central chamber when said seal is broken; and a triggering mechanism coupled to said rupturing device for maintaining separation between said rupturing device and said seal, and for moving said rupturing device to impact said seal when said triggering mechanism is activated wherein said compressed gas enters each said breech end of said plurality of launch tubes via said central chamber to propel said at least one projectile therefrom at each said muzzle end.

14. A land mine as in claim 13 wherein each said aimpoint is adjustable.

15. A land mine as in claim 13 wherein said at least one projectile is a frangible projectile housing a non-lethal marking agent.

16. A land mine as in claim 13 wherein said at least one projectile comprises a plurality of projectiles in each of said plurality of launch tubes.

17. A land mine as in claim 13 wherein said compressed gas is non-lethal.

18. A land mine as in claim 13 wherein said triggering mechanism comprises:

a spring-loaded ram coupled to said rupturing device, said spring-loaded ram having a spring-loaded position at which said separation is maintained between said rupturing device and said seal;

a locking mechanism coupled to said spring-loaded ram for maintaining said spring-loaded position; and a trip wire coupled to said locking mechanism for disabling said locking mechanism when tension is applied to said trip wire, wherein said spring-loaded ram is free to move said rupturing device to impact said seal.

* * * * *